US011492022B2

(12) United States Patent
Gronau et al.

(10) Patent No.: US 11,492,022 B2
(45) Date of Patent: Nov. 8, 2022

(54) SAND SPREADING SYSTEM AND RAIL VEHICLE WITH SUCH A SAND SPREADING SYSTEM

(71) Applicant: SIEMENS AKTIENGESELLSCHAFT, Munich (DE)

(72) Inventors: Hans-Joachim Gronau, Vierkirchen (DE); Wilfried Stelzle, Kleinberghofen (DE)

(73) Assignee: Siemens Mobility GmbH, Munich (DE)

( * ) Notice: Subject to any disclaimer, the term of this patent is extended or adjusted under 35 U.S.C. 154(b) by 928 days.

(21) Appl. No.: 16/327,937

(22) PCT Filed: Jun. 26, 2017

(86) PCT No.: PCT/EP2017/065661
§ 371 (c)(1),
(2) Date: Feb. 25, 2019

(87) PCT Pub. No.: WO2018/036690
PCT Pub. Date: Mar. 1, 2018

(65) Prior Publication Data

US 2019/0185024 A1 Jun. 20, 2019

(30) Foreign Application Priority Data

Aug. 25, 2016 (DE) ..... 102016216018.4

(51) Int. Cl.
*B61C 15/10* (2006.01)
*E01C 19/20* (2006.01)

(52) U.S. Cl.
CPC ..... *B61C 15/102* (2013.01); *E01C 19/20* (2013.01)

(58) Field of Classification Search
CPC ..... B61C 15/08; B61C 15/10; B61C 15/102; B61C 15/105; B61C 15/107; B61C 15/14
See application file for complete search history.

(56) References Cited

U.S. PATENT DOCUMENTS 4,325,573 A * 4/1982 Hefter ..... B61C 15/10 406/146
2016/0244074 A1 8/2016 Krismanic et al.
2018/0072329 A1 3/2018 Krismanic et al.

FOREIGN PATENT DOCUMENTS

CN 203567723 U 4/2014
CN 105705396 A 6/2016
RU 2504492 C1 1/2014

* cited by examiner

*Primary Examiner* — Robert J McGarry, Jr.
(74) *Attorney, Agent, or Firm* — Laurence Greenberg; Werner Stemer; Ralph Locher

(57) ABSTRACT

A sand spreading system for a rail vehicle with driveable and/or brakeable rail wheels. The sand spreading system includes a sand box for storing spreading sand, a sand staircase which is fastened to the sand box for the compressed-air-controlled metering of the output of spreading sand, and a sand outlet tube which is connected to the sand staircase via a sand hose and opens in front of a rail wheel. By a heating device for generating a hot air flow passing through the spreading sand being integrated in the sand staircase, the spreading sand can be kept dry and pourable even in the wet and frost, and therefore the function of the sand staircase and hence the effective operation of the rail vehicle are assured.

8 Claims, 2 Drawing Sheets

SAND SPREADING SYSTEM AND RAIL VEHICLE WITH SUCH A SAND SPREADING SYSTEM

BACKGROUND OF THE INVENTION

Field of the Invention

The invention relates to a sand spreading system for a rail vehicle with rail wheels which can be driven and/or braked. The sand spreading system comprises a sandbox for storing spreading sand, a sand stairway which is fastened to the sandbox and which serves for the compressed-air-controlled metering of the output of spreading sand, and a sand outlet tube which is connected to the sand stairway via a sand hose and which opens out in front of a rail wheel. A heating device for generating a hot air stream which flows through spreading sand is integrated into the sand stairway. The invention also relates to a rail vehicle equipped with a sand spreading system of said type.

A sand spreading system having the features as outlined in known from the document DD 220 863 A1.

Such sand spreading systems for rail vehicles comprise a sandbox for storing spreading sand, a sand stairway which is fastened to the sandbox and which serves for the compressed-air-controlled metering of the output of spreading sand, and a sand outlet tube which is connected to the sand stairway via a sand hose and which opens out in front of a rail wheel which can be driven and/or braked. The spreading sand which is introduced between rail wheel and rail ensures an optimum friction coefficient during launching, braking and during travel of the rail vehicle. Sand spreading systems with sand stairways are tried and tested and are known for example from the laid-open specification DE 12 79 057 A1 and the patent specification DE 26 17 331 C3.

The function of a sand spreading system with sand stairway can be greatly impaired under certain ambient conditions, for example in the presence of humidity, under wet conditions and/or in the presence of frost, whereby effective operation of the rail vehicle is jeopardized.

The invention is based on the object of providing a sand spreading system for a rail vehicle which functions even under adverse ambient conditions and which thus permits effective operation of the rail vehicle.

BRIEF SUMMARY OF THE INVENTION

The object is achieved according to the invention by means of a sand spreading system of the type mentioned in the introduction having the features as claimed. Accordingly, a heating device for generating a hot air stream which flows through spreading sand is integrated into the sand stairway. By integration of a heating device into the sand stairway, it is possible for spreading sand which has clumped together and/or frozen owing to wet conditions or ice to be heated and dried by a hot air stream. In this way, pourable spreading sand can be provided even under adverse weather conditions, in order to be able to perform sand spreading in accordance with demand at all times during the operation of the rail vehicle. By virtue of the heating device being integrated into the sand stairway, production and installation steps for a possibly separate heating device are omitted. The heating device may have one or more heat sources which, depending on the configuration, may be installed at different locations into the sand stairway in order to realize effective drying of the spreading sand. At at least one outlet, there is arranged a sintered filter through which the hot air stream flows into the sandbox. The porous sintered material of the sintered filter is permeable to the hot air stream that is generated, but preferably not to spreading sand particles, such that a blockage of the outlet by spreading sand from the sandbox is prevented.

In one advantageous embodiment of the sand spreading system according to the invention, the sand stairway has a stairway housing with a fastening flange for the fastening thereof to the sandbox, wherein, in the fastening flange, there extends a channel system for accommodating the heating device and for conducting an air stream which passes through the heating device. The channel system may for example be formed by a system of transverse and longitudinal channels which are connected in terms of flow, and which are designed as blind bores or passage bores drilled into the fastening flange. A channel system in which the heating device can be arranged and the air for generating the hot air stream can be conducted is easy to produce from a manufacturing aspect.

The channel system of the sand spreading system according to the invention has one or more port openings through which in each case one rod-shaped heating element of the heating device can be inserted from the outside. The heating device may, depending on the heating requirements, have one or more rod-shaped heating elements which can be inserted into the channel system from the outside through port openings. The port openings are provided on side surfaces of the fastening flange such that, when the sand stairway has been flange-mounted onto the sandbox, it is easily possible for heating elements to be installed or exchanged. The ease of maintenance of the sand spreading system according to the invention is thus improved.

In a preferred embodiment of the sand spreading system according to the invention, the channel system has one or more inlets for a supply air stream and one or more outlets for a hot air stream. One or more compressed air lines for the feed of a supply air stream may be connected to the inlets, which are preferably likewise arranged at the easily accessible side surfaces of the fastening flange. The supply air stream is conducted through the channel system to the one or more heating elements in order to be heated as it passes through. The hot air stream thus generated then exits the sand stairway through outlets of the channel system, which outlets may for example be arranged in an upwardly pointing flange surface of the fastening flange. The hot air stream which rises into the sandbox thus passes through the downwardly sliding spreading sand, whereby particularly effective drying of the sand in an opposing-flow configuration is achieved.

The supply air stream is preferably controllable independently of a compressed air stream that can be fed to the sand stairway of the sand spreading system according to the invention for the metering of the output of spreading sand. By virtue of the fact that pressure and volume flow of the supply air stream for the heating device can be set separately, the amount of heat can be provided in accordance with demand and irrespective of the required spreading sand quantity. This possibility is eliminated if the hot air stream were identical to the compressed air stream fed for the metering of the output of spreading sand.

In a preferred embodiment of the sand spreading system according to the invention, at at least one outlet, there is arranged a sintered filter through which the hot air stream flows into the sandbox. The porous sintered material of the sintered filter is permeable to the hot air stream that is generated, but not to spreading sand particles, such that a blockage of the outlet by spreading sand from the sandbox is prevented.

It is preferable for the sintered filter to be of frustoconical form and to project from the fastening flange into the sandbox. By means of the conical form of the sintered filter, a large filter area projecting into the sandbox is formed, such that the exiting hot air stream passes through a large layer thickness of spreading sand situated above the flange surface.

In one advantageous embodiment of the sand spreading system according to the invention, the stairway housing is formed as a single piece, for example produced by means of a casting process or a 3D printing process such as laser or electron beam melting. For a sand stairway with its complex external and internal shape which forms the sand path, a cast part is firstly easy to produce, and secondly is a good heat conductor for the heat energy released by the integrated heating device. Owing to the form as a single piece, heat barriers in the sand stairway are avoided, whereby the heat energy is distributed in an effective manner in the stairway housing and thus contributes to effective drying even of the spreading sand which is situated in the depression of the stairway housing.

A rail vehicle, in particular a locomotive or a rail motor unit, which has at least one rail wheel which can be driven and/or braked is, according to the invention, equipped with a sand spreading system as claimed. In this way, drive and braking processes can be performed in an effective manner even under adverse weather conditions characterized by moisture and low temperatures.

BRIEF DESCRIPTION OF THE SEVERAL VIEWS OF THE DRAWING

Further characteristics and advantages of the invention will emerge from the following description of the drawings, in which, in each case schematically.

DESCRIPTION OF THE INVENTION

Figure 1:
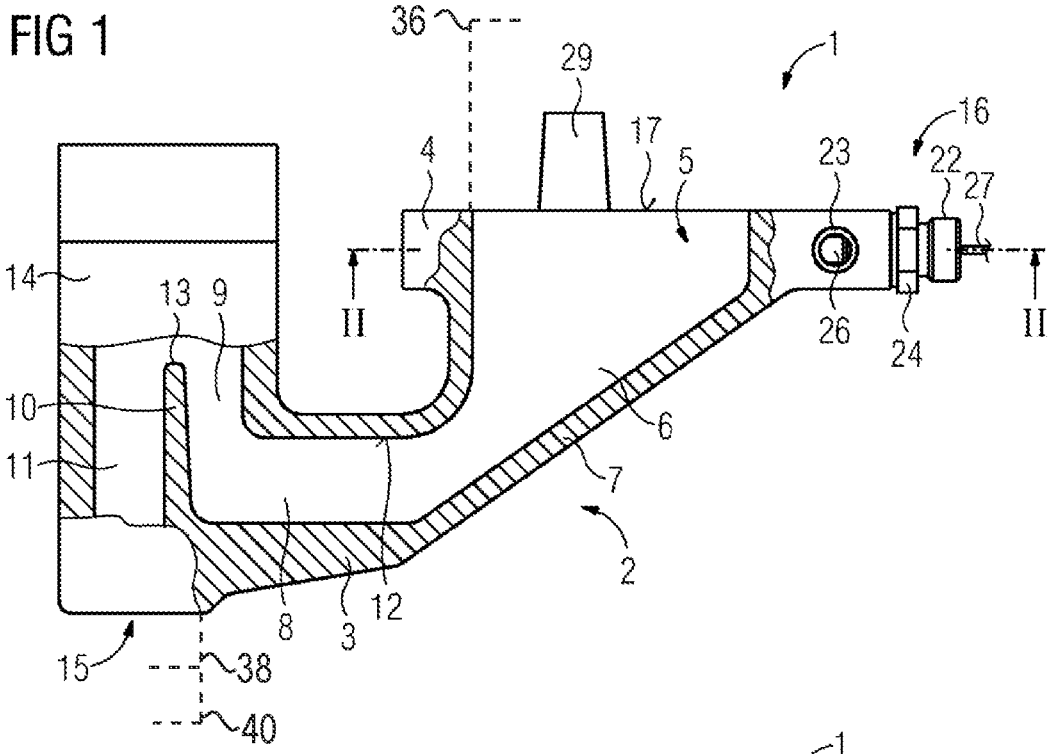
FIG. 1 shows a sanding system according to the invention with sand stairway in a partially sectional side view.

As per FIG. 1, a sand spreading system 1 for a rail vehicle (not illustrated), for example a locomotive, with rail wheels which can be driven and/or braked comprises a sandbox 36 for storing spreading sand. Below the sandbox 36, there is fastened a sand stairway 2 for the compressed-air-controlled metering of the output of spreading sand. The sand stairway 2 is connected via a sand hose 38 to a sand outlet tube 40 which opens out in front of the rail wheel in a direction of travel. The parts which are not illustrated are known per se. The sand stairway 2 has a stairway housing 3 formed as a single-piece cast part, through which a siphon-like, substantially S-shaped sand path extends. The stairway housing 3 has a fastening flange 4 for the fastening thereof to the sandbox 36. Spreading sand emerges from the sandbox 36 through a sand inlet opening 5 provided in the fastening flange 4, and slides into a funnel-shaped depression 6, adjoining said sand inlet opening, of the stairway housing 3. The base wall 7 of the depression 6 expediently has an angle of inclination which, in relation to the angle of repose of the spreading sand used, promotes a sliding-down movement. The depression 6 is adjoined by a horizontal, relatively narrow channel piece 8 which acts as a throttling point for the spreading sand that slides down. In this way, a situation is prevented in which an excessive amount of spreading sand slides down out of the sandbox 36 in the event of vibrations of the rail vehicle. The channel piece opens into a sand chamber 9 which is separated by a vertical partition 10 from a blow-out channel 11 of the stairway housing 3. Here, an apex 12 of the channel piece 8 is situated below an upper edge 13 of the partition 10 and thus below an inlet opening of the blow-out channel 11 extending vertically downward from said upper edge. Above the blow-out channel 11 and the sand chamber 9, compressed air is fed from above via a nozzle block 14, which has two nozzles 30, 31, of the stairway housing 3. From a first nozzle 30, an air jet flows into the sand chamber 9, such that spreading sand is swirled up therein. The swirled-up spreading sand is entrained by the air jet flowing out of the second nozzle 31, and is conveyed through the blow-out channel 11, which it exits through a sand outlet opening 15 of the stairway housing 3. Connected to the sand outlet opening 15 is the sand hose 38 which ends with the sand outlet tube 40 and from which the gap between rail wheel and rail is impinged on with spreading sand for the purposes of increasing the friction coefficient.

As per FIG. 1 to FIG. 4, a heating device 16 for generating a hot air stream which flows through spreading sand is integrated into the sand stairway 2 according to the present invention. In this way, the spreading sand is dried and kept in a pourable state. By integrating the heating device 16 into the sand stairway 2, additional components and associated production and assembly costs are saved. For the integration of the heating device 16, a channel system for accommodating the heating device 16 and for conducting an air stream which passes through the heating device 16 extends in the fastening flange 4 of the stairway housing 3.

Figure 2:
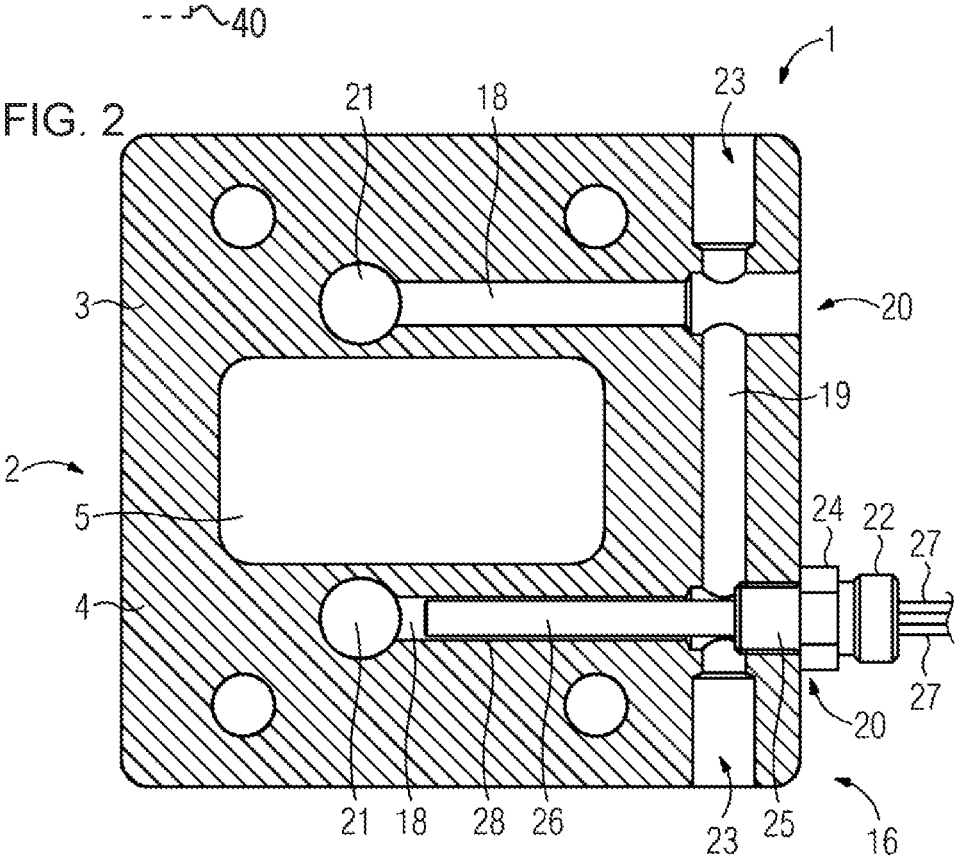
FIG. 2 shows a section through the fastening flange of the sand stairway along the section line II-II indicated in FIG. 1.
Figure 3:
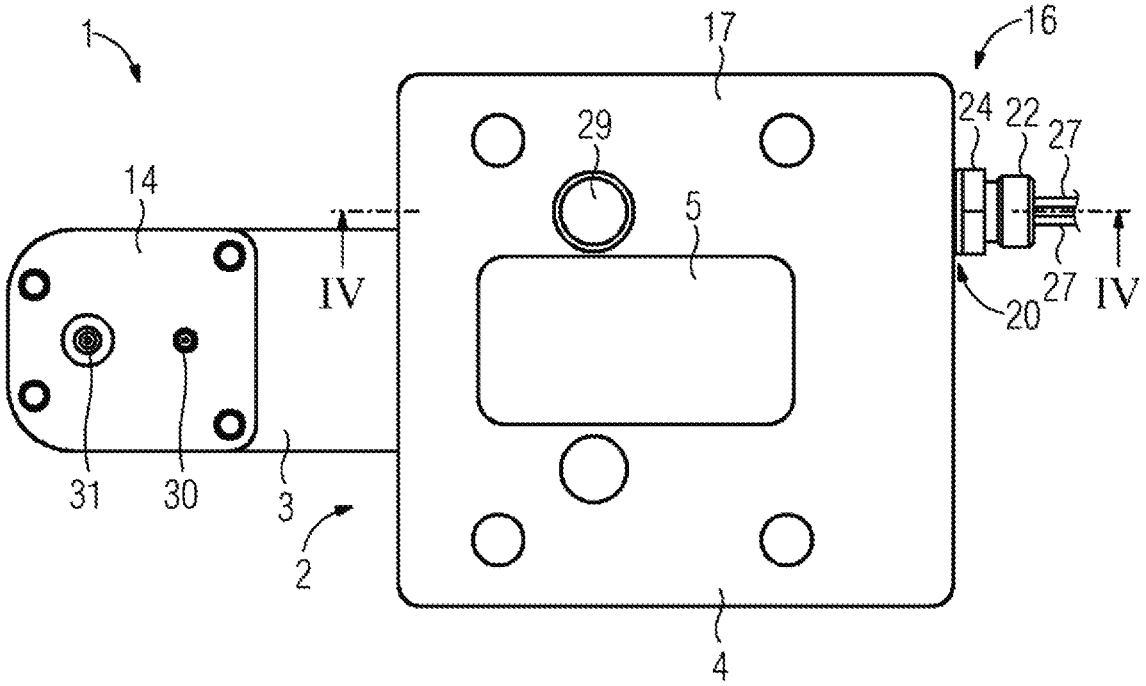
FIG. 3 shows the sanding system as per FIG. 1 in a plan view.

As per FIG. 2, the channel system runs parallel to an approximately square flange surface 17 of the fastening flange 4, and has two parallel longitudinal channels 18 and, perpendicular to these, a transverse channel 19 which intersects the longitudinal channels 18, whereby a communicating channel system is formed. Each of the longitudinal channels 18 runs from a lateral port opening 20 into the fastening flange 4 and opens into in each case one blind bore situated to both sides of the rectangular sand inlet opening 5, which blind bore is open to the flange surface 7 and forms an outlet 21. Through a port opening 19, a rod-shaped heating element 22 of the heating device 16 is inserted from the outside into the longitudinal channel 18 and is fastened by means of a screw connection. Depending on the heat quantity required for the drying of the spreading sand, the port opening 20 of the other longitudinal channel 18 can either be closed off by means of a closure piece (not illustrated) or equipped with a second rod-shaped heating element 22 (likewise not illustrated). For the compressed-air-tight closure of the port openings 20, the longitudinal channels 18 have internal attachment threads for the screw connections. The transverse channel 19 is formed as a passage bore and, at opposite face surfaces of the fastening flange 4, has in each case one inlet 23 to which a compressed air line (not illustrated) for the feed of a supply air stream can be connected. If a greater supply air stream is required for the drying of the spreading sand, for example if both longitudinal channels 18 are equipped with heating elements 22, compressed air lines may be connected to both inlets 23.

Otherwise, the inlet 23 that is not required for a compressed air line is closed in compressed-air-tight fashion by means of a closure piece. A particular advantage lies in the separation of the supply air stream provided via the compressed air lines from the compressed air stream fed for the metering of the output of spreading sand, such that the former is controllable independently of the spreading sand requirement, only in accordance with the present heat requirement.

Figure 4:
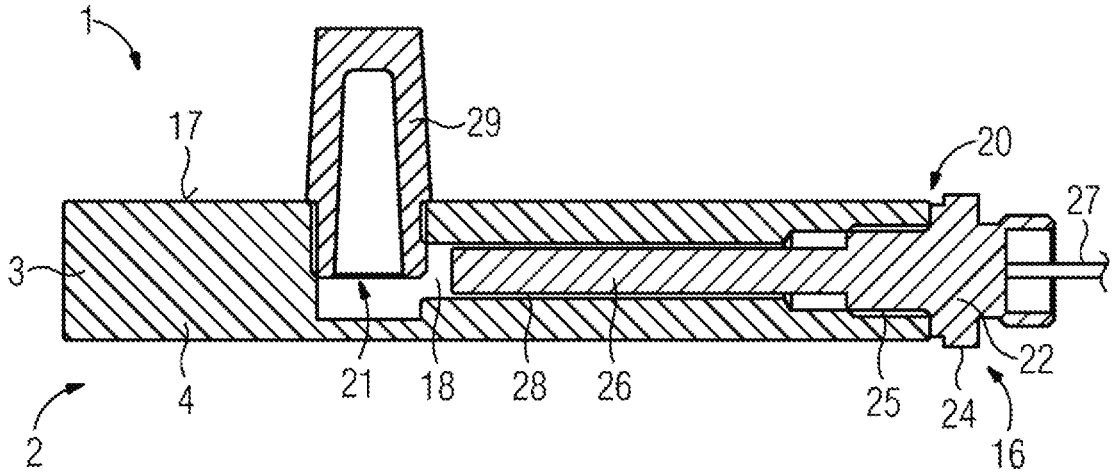
FIG. 4 shows a longitudinal section through the fastening flange of the sand stairway along the section line IV-IV indicated in FIG. 3.

As per FIG. 4, a heating element 22 comprises an external hexagonal portion 24 for the engagement of a fastening tool, an adjoining external thread portion 25 for the screw connection to the internal attachment thread of the longitudinal channel 18, and a heating rod 26 adjoining said external thread portion, which heating rod extends through the longitudinal channel 18 almost as far as the outlet 21. The heating rod 26 converts electrical energy, which is fed by means of supply lines 27 connected externally at the end side, into heat energy. From the one or more lateral inlets 23, a supply air stream flows through the transverse channel 19 onward into the longitudinal channels 18 through a ring-shaped gap 28 surrounding the heating rod 26. Here, the air flowing past the heating rod 26 heats up and forms a hot air stream, which flows through the outlet 21 into the spreading sand to be dried. At the outlet 21, there is arranged a sintered filter 29 which is permeable to the hot air stream but not to spreading sand, in order to prevent blockage of the outlet 21. The sintered filter 29 screwed into the outlet 21 is of frustoconical form and projects upward from the flange surface 17 of the fastening flange 4 into the sandbox. The hot air stream exiting the one or more sintered filters 29 flows upward through the downwardly sliding spreading sand in the sandbox. By means of this opposing flow principle, particularly effective drying of the spreading sand is achieved. Additionally, by means of the elongate heating rods 26, the fastening flange 4 is heated up, which additionally releases heat to the downwardly sliding spreading sand. Owing to the single-piece form of the stairway housing 3 formed as a cast part or 3D printed part, said stairway housing is also heated, by heat conduction, in the region of the depression 6, such that the spreading sand situated therein is also dried.

The invention claimed is:

1. A sand spreading system for a rail vehicle with rail wheels, the sand spreading system comprising:

a sandbox for storing spreading sand, a sand stairway fastened to said sandbox and configured for compressed-air-controlled metering of a spreading sand output;

a sand outlet tube opening out in front of a rail wheel, and a sand hose connecting said sand outlet tube to said sand stairway;

a heating device integrated into said sand stairway for generating a hot air stream to flow through the spreading sand;

said sand stairway having a stairway housing with an integrally formed fastening flange for fastening to said sandbox;

said fastening flange being formed with a sand inlet opening and a channel system for accommodating said heating device and for conducting an air stream that passes through said heating device, said channel system having at least two parallel channels on opposite sides of said inlet opening and at least one outlet for the air stream;

said sand outlet tube being below and laterally offset from said sand inlet opening, and said sand stairway having an angled surface configured to receive sand from said sand box through said sand inlet opening and direct sand laterally to said sand hose and said sand outlet tube; and a sintered filter disposed at said at least one outlet of said channel system, wherein the air stream heated by said heating device flows through said sinter filter and into the sandbox.

2. The sand spreading system according to claim 1, wherein said channel system includes one or more port openings each configured to receive a rod-shaped heating element of said heating device to be inserted from outside.

3. The sand spreading system according to claim 2, wherein said stairway housing is formed as a single piece.

4. The sand spreading system according to claim 1, wherein said channel system is formed with one or more inlets for a supply air stream.

5. The sand spreading system according to claim 4, wherein the supply air stream is controllable independently of a compressed air stream to be fed to said sand stairway for metering the output of spreading sand.

6. The sand spreading system according to claim 5, wherein said sintered filter has a frustoconical shape and projects from said fastening flange into said sandbox.

7. A rail vehicle, comprising at least one rail wheel to be driven and/or braked, and a sand spreading system according to claim 1.

8. The rail vehicle according to claim 7 being a locomotive.

* * * * *